United States Patent [19]

Barna

[11] 4,244,346

[45] Jan. 13, 1981

[54] STRESS RELIEVING BRACKET FOR MOUNTING A PULLEY ON THE END OF A COMPOUND BOW

[76] Inventor: Alex J. Barna, 1216 Crawford St., Duquesne, Pa. 15110

[21] Appl. No.: 14,533

[22] Filed: Feb. 23, 1979

[51] Int. Cl.[3] ..... F41B 5/00

[52] U.S. Cl. ..... 124/24 R; 124/86

[58] Field of Search ..... 273/191, 81; 124/23 R, 124/24 R, 86, 90; 14/13, 14

[56] References Cited

U.S. PATENT DOCUMENTS

| | | | |
|---|---|---|---|
| 1,780,579 | 11/1930 | Crowley | 14/14 X |
| 2,426,283 | 8/1947 | Pearson | 124/23 R |
| 4,060,066 | 11/1977 | Kudlacek | 124/90 X |

*Primary Examiner*—Richard C. Pinkham
*Assistant Examiner*—William R. Browne
*Attorney, Agent, or Firm*—Stanley J. Price, Jr.; John M. Adams

[57] ABSTRACT

A compound bow includes a pair of limbs each having a first end portion connected to a handle member and a second or free end portion. A bracket is connected to a free end portion of each limb of a compound bow. The bracket has a limb engaging portion positioned in abutting relation with the limb free end portion and a pair of plates extending outwardly therefrom. A pulley is positioned between the plates and is eccentrically and rotatably connected thereto. A continuous cable is reeved about the pulleys. Aligned bores extend through the bracket and limb free end portion. Fastening members extend through the aligned bores to secure the bracket to the limb. The bores through the limb have a diameter greater than the diameter of the fastening members. Thus the fastening members are secured to the bracket but are removed from contact with the limb. The stresses generated by tightening the fastening members into engagement with the bracket are not transmitted to the limb to prevent weakening and eventual failure of the limb by cracking or splitting at the point where the bracket is mounted on the limb.

7 Claims, 3 Drawing Figures

STRESS RELIEVING BRACKET FOR MOUNTING A PULLEY ON THE END OF A COMPOUND BOW

BACKGROUND OF THE INVENTION

1. Field of the Invention

This invention relates to a compound bow and more particularly to a mounting bracket for a compound bow in which the bracket is secured to the free end portion of a limb of the bow in a manner that reduces the stresses applied to the end of the limb by the connection of the bracket to the limb.

2. Description of the Prior Art

Compound bows, as well known in the art, include pulleys, wheels, or the like that are secured to the free ends of the bow limbs. The cable or arrow string is reeved about the pulleys, and with this arrangement a mechanical advantage is provided to increase the amount of potential energy stored in the limbs as the arrow string is drawn. Numerous arrangements are utilized to rotatably support the pulleys about an eccentric axis at the limb free end portions.

One method of rotatably mounting pulleys or the like on the free end portions of the bow limbs is disclosed in the following U.S. Pat. Nos.: 3,486,495; 3,958,551; 4,061,124 and 4,054,118 and includes the limb tips or free end portions having bifurcations in which a pin or axle is positioned. The eccentric pulley is rotatably mounted on the pin. It is believed, however, that a bow limb having a bifurcated tip for receiving and supporting an eccentrically mounted pulley has reduced structural strength in view of the bifurcation of the tip and subsequently has a failure rate exceeding that of compound bows with tips which are not bifurcated.

The limbs of the compound bow with a cable extending between the tips of the limbs is subjected to a constant torque. The torque is increased when the arrow string portion of the cable is pulled to the full draw position. Thus the bow limbs are under constant stress, and the resistance of the bow limbs to stress is substantially reduced by the bifurcated nature of the limb tips. This contributes to splitting or breaking of the bow limbs at the tips.

Another arrangement for mounting pulleys, wheels and like devices on the outer end portions of the limbs of a compound bow is disclosed in U.S. Pat. No. 4,064,862. Mounting brackets are fixedly secured to the outer end portions of the limbs by suitable fastening members that extend through aligned holes in the brackets and the end portions of the limbs. The fastening members extend through the aligned holes and engage the limbs. However, by engaging the fastening means to the limbs the outer end portions of the limbs are subjected to increased stress and are substantially weakened to resist the bending stresses applied to the limb end portions when the arrow string is drawn. This arrangement is known to result in failure of a limb by splitting or breaking at the point of contact of the fastening members with the limb end portions.

Therefore, there is need for an arrangement of securely mounting brackets on the outer end portions of compound bow limbs for rotatably supporting cable supporting devices that overcomes the disadvantages encountered with bifurcated limb end portions and threadedly engaging fastening members to the limb end portions. Thus by preventing a reduction in the resistance of the limb end portions to the torque applied thereto by bifurcating the limb end portions or by threadedly securing fastening members thereto in order to mount brackets on the limbs, failure of the bow limbs can be substantially prevented.

SUMMARY OF THE INVENTION

In accordance with the present invention there is provided a compound bow that includes a pair of limbs. Each of the limbs has a first end portion and a second end portion. Handle means is provided for connecting the first end portions of the pair of limbs. A bracket is connected to the second end portion of at least one of the pair of limbs for rotatably supporting a rotatable member on the second end portion. The bracket has a limb engaging portion and a rotatable member supporting portion extending outwardly from the limb engaging portion. The rotatable member supporting portion is adapted to rotatably support a rotatable member in spaced relation from the limb second end portion. The limb second end portion and the limb engaging portion have aligned bores. Fastening devices extend through the aligned bores for securing the bracket to the limb second end portion. The fastening devices engage the bracket and extend through the bore of the limb second end portion removed from engagement with the limb second end portion so that the limb second end portion is free of the stresses imparted thereto by the fastening devices.

Preferably, the limb engaging portion of the bracket has a channel-shaped configuration for receiving the second end portion of the respective limb. The channel-shaped configuration is formed by a pair of shaped, parallel plates connected at adjacent end portions thereof by an end plate which extends substantially perpendicular to the spaced parallel plates. The limb second end portion extends between and in abutting relation with the spaced parallel plates. The end of the limb second end portion abuts the end plate so that the limb second end portion is securely positioned in the channel formed by the bracket limb engaging portion.

Aligned bores extend through the spaced parallel plates and are arranged to receive the fastening devices. These bores are aligned with the bores through the limb second end portion. Most preferably the bores of the limb second end portion have a diameter greater than the diameter of the bores through the bracket limb engaging portion. The fastening devices may be threaded members, such as screws, having an enlarged head at one end portion and a threaded end portion opposite the head. With this arrangement the threaded member enlarged head securely seats on one plate and the threaded end portion engages the other plate in the bore thereof. Thus the threaded members are securely engaged with the plates of the limb engaging portion. However, due to the fact that the diameter of the bores through the limb second end portion are greater than the diameter of the bores through the plates of the limb engaging portion, the intermediate portion of the threaded members pass through the bores of the limb without contacting the limb. Thus the bracket is securely connected to the limb but because the threaded members do not engage the limb, the stresses imparted by tightening the threaded members are not transmitted to the limb. This substantially reduces failure of the limb as encountered when the threaded members engage the limb.

Accordingly, the principal object of the present invention is to provide a compound bow having an improved bracket that is mounted on the free end portions of the limbs of the compound bow for supporting a rotatable member, such as a pulley, wheel or the like, without subjecting the ends of the limbs to stresses imparted thereto by the connection of the brackets to the ends of the limbs.

Another object of the present invention is to provide a bracket assembly for a compound bow in which the bracket assembly is secured to the free end portion of the limb of the compound bow to rotatably support a pulley thereon without weakening the end of the limb and subjecting the limb to stresses resulting in failure of the limb.

These and other objects of the present invention will be more completely disclosed and described in the following specification, the accompanying drawings and the appended claims.

DESCRIPTION OF THE PREFERRED EMBODIMENT

Figure 1:
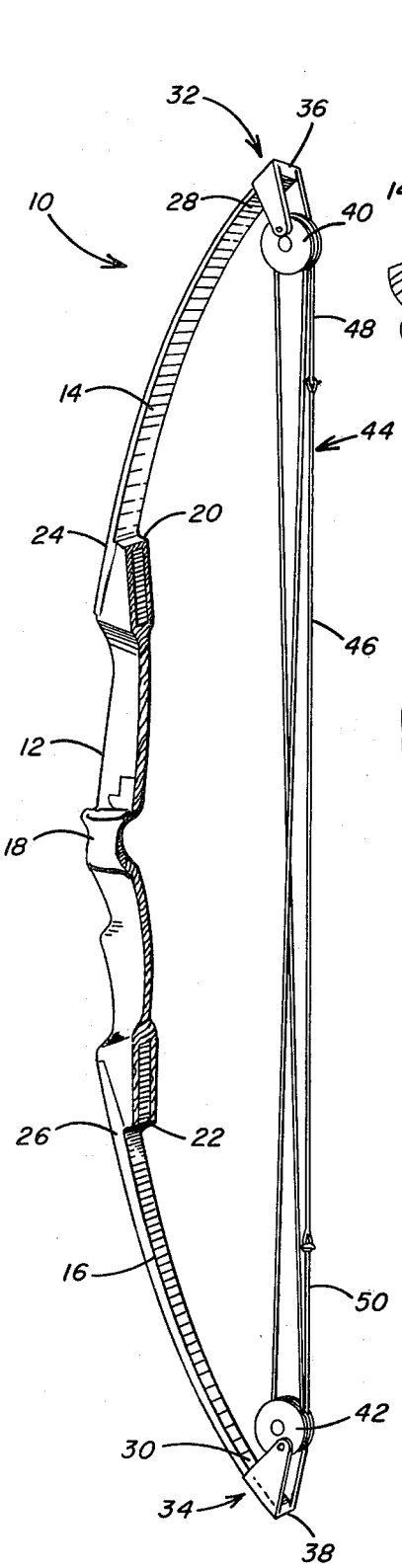
FIG. 1 is a perspective view of a compound bow, illustrating an improved bracket assembly mounted on the free end portions of the limbs of the compound bow for rotatably supporting pulleys that receive a continuous cable for flexing the bow limbs.

Referring to the drawings, and particularly to FIG. 1, there is illustrated a compound bow generally designated by the numeral 10 having a handle member 12 and a pair of limbs 14 and 16. The handle member 12 includes a grip portion 18 and opposite end portions 20 and 22. The limbs 14 and 16 include first end portions 24 and 26 connected to the handle member end portions 20 and 22 respectively in a suitable manner. The limbs 14 and 16 may be connected to the handle end portions 20 and 22 in a manner to permit pivoting of the limbs 14 and 16 about their connections to the handle member 12 so that adjustments in the flexure of the limbs can be made. Suitable adjustment devices are well known in the art and are beyond the scope of the present invention and therefore will not be described herein.

The limbs 14 and 16 include second or free end portions 28 and 30 as well as back and belly portions. A pair of pulley and cable mounting assemblies 32 and 34 are secured to the limb free end portions 28 and 30 in accordance with the present invention. The mounting assemblies 32 and 34 include brackets 36 and 38 respectively which are secured to the limb free end portions to rotatably and eccentrically support a pair of pulleys 40 and 42. The continuous cable 44 is reeved about the pulleys 40 and 42 to extend between the limb free end portions 28 and 30. The continuous cable 44 includes a flexible section 46 for receiving an arrow and cable sections 48 and 50 which are suitably connected to the end portions of the flexible section 46. The cable section 48 is reeved about the pulley 40 and extends to the opposite pulley 42 for connection therewith. Similarly, the cable section 50 is connected to the opposite end portion of the flexible section 46 and is reeved about pulley 42 and extends to pulley 40 for connection therewith.

Preferably, the cable sections 48 and 50 are fabricated of steel wire or any other suitably strong material. The flexible section 46 of the continuous cable 44 extends between the pulleys 40 and 42 and is arranged to receive the end of the arrow. Suitable devices (not shown) may be associated with each of the pulleys 40 and 42 to vary the length of the cable 44 that extends between the pulleys to permit adjustments in the draw length of the cable flexible section 46 and accordingly the draw weight of the bow.

Figure 2:
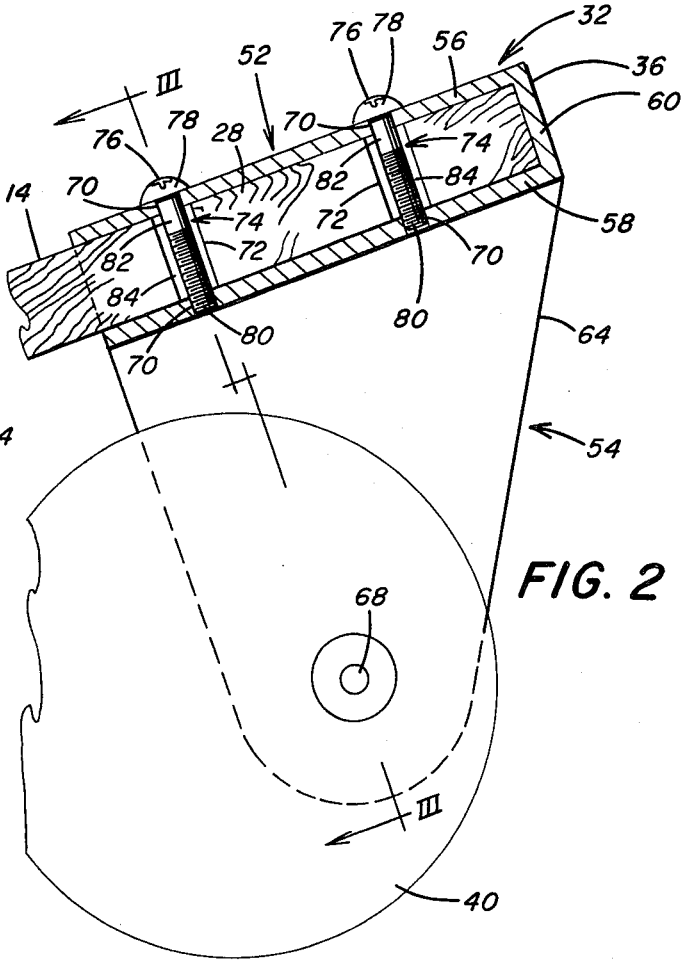
FIG. 2 is an enlarged fragmentary view, partially in section, of the free end portion of one limb of the compound bow, illustrating the bracket assembly of the present invention connected to the limb by fastening members that engage the bracket assembly but are removed from engagement with the body of the limb.
Figure 3:
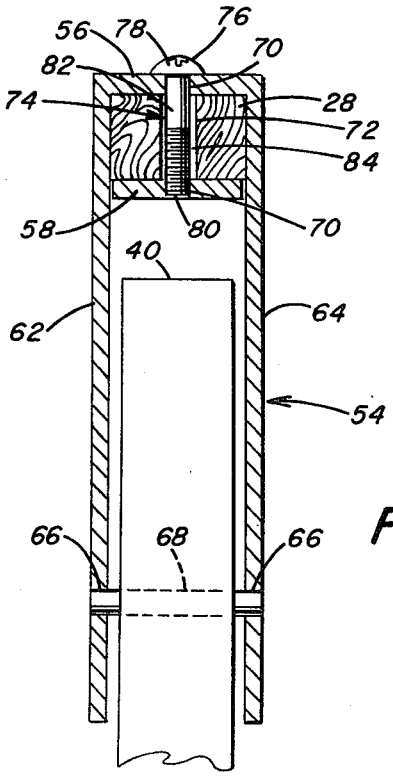
FIG. 3 is an end view in section of the bracket assembly illustrated in FIG. 2, showing the contact of the fastening member with the bracket and the displacement of the fastening member with the body of the limb.

Referring to FIGS. 2 and 3, the pulley and cable mounting assembly 32 is shown in greater detail. It should be understood that the structure of the assembly 32 is identical to the structure of the pulley and cable mounting assembly 34 on the opposite limb 16; therefore, the description of the mounting assembly 32 is also applicable to the mounting assembly 34. The mounting assembly 32 includes the bracket 36, as above described, which includes a limb engaging portion generally designated by the numeral 52 and a rotatable member supporting portion generally designated by the numeral 54. The limb engaging portion 52 receives the free end portion 28 of the limb 14. The rotatable member supporting portion 54 is connected to and extends outwardly from the limb engaging portion 52 and rotatably supports the pulley 40 or any other desired rotatable member for receiving the continuous cable 44, which is not illustrated in FIGS. 2 and 3.

The limb engaging portion 52 has a channel-shaped configuration for slidably receiving the limb free end portion 28. One end of the limb engaging portion 52 is closed and the opposite end portion is open. The limb engaging portion 52 includes a pair of spaced, parallel plates 56 and 58 which are connected adjacent the end portions by a plate 60 that extends perpendicular relative to the plates 56 and 58 to form the closed end portion against which the extreme end of the limb free end portion 28 abuts. As illustrated in FIG. 3, the channel formed by the connected plates 56, 58 and 60 is arranged to slidably receive the surfaces of the limb 14 so that the bracket 36 is securely mounted on the limb free end portion 28.

The rotatable member supporting portion 54 of the bracket 36 includes a pair of spaced, parallel plates 62 and 64 that are secured to and extend outwardly from the plates 56. The plates 62 and 64 are spaced a preselected distance apart and have a preselected configuration as illustrated in FIG. 2 for receiving the pulley 40 between the plates 62 and 64. Each of the plates 62 and 64 includes a bore 66 adjacent the tapered end portion of each plate. The bores 66 are aligned to receive the end portions of an axle 68 that rotatably supports the pulley 40 positioned between the plates 62 and 64. Suitable means, not shown, may be provided for releasably connecting the axle 68 with the plates 62 and 64 to permit assembly and disassembly of pulley 40 on the bracket 36.

Each of the plates 56 and 58 includes aligned bores 70 that extend through the respective plates. The bores 70 are axially aligned with bores 72 that extend through the limb free end portion 28. The aligned bores 70 and 72 are arranged to receive suitable fastening devices generally designated by the numerals 74. Preferably, each of the fastening devices 74 is a conventionally threaded member or screw 76 having an enlarged end portion 78 and a threaded end portion 80 with a shank or intermediate portion 82 connecting the head with the threaded end portion.

In accordance with the present invention the diameter of the bore 70 in the plates 56 and 58 is substantially equal to the diameter of the shank 82 of the screw 76 so that the screw 76 contacts the plates 56 and 58. Preferably, the bores 70 in the lower plates 58 threadedly receive the threaded end portion 80 of the screws 76. The diameter of the enlarged head 78 is greater than the diameter of the bores 70 in the upper plate 56 so that the head 78 of each screw 76 securely abuts the plate 56 upon threaded connection of the threaded end 80 with the lower plate 58. With this arrangement the bracket 36 is securely connected to the limb free end portion 28.

As above described the diameter of the bore 72 through the limb is greater than the diameter of the bores 70 through the plates 56 and 58 and accordingly the diameter of the shank 82 of each screw 76. Thus, the screws 76 pass through the bores 70 in contact with the plates 56 and 58 but pass through the bores 72 removed from contact with the limb free end portion 28. The screws 76 are spaced from contact with the body of the limb 14 surrounding the screws 76 so that an annular space 84 is formed around the screws 76 in the bores 70.

By advancing the screws 76 into engagement with the threaded bores 70 of the plate 58, the enlarged head 78 of each screw 76 is rigidly positioned in contact with the plate 56 so that the plates 56 and 58 securely engage the limb 14. By maintaining the screws 76 removed from contact with the body portion of the limb 14 the stresses generated by the screws 76 are not transmitted to the limb 14. This permits the bracket 36 to be securely mounted on limb 14 without the limb receiving the stresses applied by the screws 76 which stresses may be of sufficient magnitude to result in failure of the limb 14 by splitting of the free end portion 28.

Thus with the present invention the limbs 14 and 16 are not weakened by the connection of the pulley and cable mounting assemblies 32 and 34 to the limbs 14 and 16. The stresses and forces generated by the screws 76 are absorbed by the bracket plates 56 and 58 and are not transmitted to the limbs even though the plates are securely clamped on the limb free end portion 28. The forces applied thereto are uniform and are not localized as in the case when the screws 76 contact and engage the body portion of the limb.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A compound bow comprising, a pair of limbs, each of said limbs having a first end portion and a second end portion, handle means connecting said first end portions of said pair of limbs, bracket means connected to said second end portion of at least one of said pair of limbs for rotatably supporting a rotatable member on said second end portion, said bracket means having a limb engaging portion and a rotatable member supporting portion extending outwardly from said limb engaging portion, said limb engaging portion forming a removable pocket, said pocket including a pair of oppositely positioned plates arranged to receive only said limb second end portion in surrounding relation, said pair of plates engaging the back and belly of said limb second end portion to thereby securely mount said bracket means on said limb second end portion, said rotatable member supporting portion being adapted to rotatably support a rotatable member in spaced relation from said limb second end portion, said limb second end portion and said pair of plates of said limb engaging portion having aligned bores, fastening means extending through said aligned bores, said fastening means including elongated members, each said elongated member having opposite end portions engaging only said pair of plates respectively to securely connect said pair of plates to said limb second end portion, and said fastening means being removed from engagement with said limb second end portion so that the stresses generated by said fastening means are not transmitted directly to said limb second end portion but are transmitted to said pair of plates.

2. A compound bow as set forth in claim 1 which includes, said fastening means being threadedly engaged to said bracket means, and said fastening means passing through said bore of said limb second end portion from contact therewith.

3. A compound bow as set forth in claim 1 which includes, said pair of plates of said bracket means limb engaging portion being positioned in overlying abutting relation with the opposite surfaces of said limb second end portion, said fastening means extending through said limb engaging portion and being connected thereto, and said fastening means extending through said bore of said limb second end portion removed from contact with said limb second end portion to thereby position said pair of plates in contact with said limb second end portion and prevent the forces generated by said fastening means from being transmitted directly to said limb second end portion.

4. A compound bow as set forth in claim 1 which includes, said bracket means limb engaging portion having a channel-shaped configuration formed by said pair of plates, said pair of plates being positioned in spaced parallel relation and connected at adjacent end portions thereof by an end plate, said limb second end portion being arranged to extend between and in abutting relation with said spaced parallel plates with the end of said limb second end portion abutting said end plate, said aligned bores extending through said spaced parallel plates, and said fastening means extending through said aligned bores and being securely engaged at said opposite end portions with said spaced parallel plates to connect said bracket means to said limb second end portion.

5. A compound bow as set forth in claim 1 which includes, said aligned bores of said bracket means limb engaging portion and said limb second end portion being arranged to receive said fastening means with said fastening means being connected to said bracket means limb engaging portion, and said bore through said limb second end portion having an enlarged diameter so that said fastening means passes through said limb second end portion removed from contact therewith.

6. A compound bow as set forth in claim 1 in which, said fastening means including a threaded member, said threaded member having an enlarged end portion operable to securely contact one of said pair of plates and a threaded end portion operable to securely engage the other one of said plates, said fastening means having an intermediate portion between said enlarged end portion and said threaded end portion, and said intermediate portion arranged to extend through said bore of said limb second end portion without engaging the body of the limb second end portion surrounding said bore therethrough.

7. A mounting bracket for a compound bow comprising, a limb engaging portion, said limb engaging portion forming a removable pocket, said pocket including a pair of oppositely positioned plates, said pair of plates being adapted to engage the back and belly of a free end portion of a limb of a compound bow, a rotatable member supporting portion, said rotatable member supporting portion extending outwardly from said limb engaging portion, said rotatable member supporting portion being adapted to rotatably support a rotatable member in spaced relation with a free end portion of a limb, and aligned bores extending through said pair of plates of said limb engaging portion, fastening means extending through said aligned bores for connecting said limb engaging portion to a free end portion of a limb, and said fastening means including elongated members, each said elongated member being arranged to securely engage only said limb engaging portion and pass through a free end portion of a limb out of direct contact therewith so that the engaging forces exerted by said fastening means are absorbed by said pair of plates and are not transmitted directly to the limb free end portion.

* * * * *